US007613408B2

(12) United States Patent
Karasawa et al.

(10) Patent No.: US 7,613,408 B2
(45) Date of Patent: Nov. 3, 2009

(54) IMAGE FORMING APPARATUS FOR CORRECTING IMAGE FORMATION CONDITION

(75) Inventors: Minoru Karasawa, Tsukuba (JP); Yukimasa Yoshida, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 289 days.

(21) Appl. No.: 11/535,593

(22) Filed: Sep. 27, 2006

(65) Prior Publication Data

US 2007/0077078 A1 Apr. 5, 2007

(30) Foreign Application Priority Data

Sep. 30, 2005 (JP) ..... 2005-286454

(51) Int. Cl.
*G03G 15/00* (2006.01)

(52) U.S. Cl. ..... 399/43; 399/49

(58) Field of Classification Search ..... 399/49, 399/43, 60

See application file for complete search history.

(56) References Cited

U.S. PATENT DOCUMENTS 5,057,867 A * 10/1991 Ishigaki et al.
5,245,389 A * 9/1993 Yoshiyama et al.
6,384,934 B1 * 5/2002 Kohtani et al.
7,359,653 B2 * 4/2008 Okamoto
2006/0152775 A1 * 7/2006 Itoyama et al.

FOREIGN PATENT DOCUMENTS

| | | | |
|---|---|---|---|
| EP | 0736815 | A1 | 3/1996 |
| JP | H05-289458 | A | 11/1993 |
| JP | H07-175280 | A | 7/1995 |
| JP | H10-239962 | A | 9/1998 |
| JP | 2001-265094 | A | 9/2001 |
| JP | 2003173074 | A | 6/2003 |

OTHER PUBLICATIONS

European Patent Office; Extended European Search Report dated Jan. 10, 2007 for Related EP Application No. 06020317.1.

* cited by examiner

*Primary Examiner*—Susan S Lee
(74) *Attorney, Agent, or Firm*—Baker Botts, LLP

(57) ABSTRACT

An image forming apparatus includes: an image forming unit that forms an image by forming an electrostatic latent image on an image carrying body, developing the electrostatic latent image by sticking a developer on the image carrying body, and transferring the developer to a recording subject medium; a suspension time calculating unit that calculates a suspension time for which image formation by the image forming unit is suspended; and a correction amount calculating unit that calculates a correction amount for an image formation condition of the image forming unit based on the suspension time calculated by the suspension time calculating unit.

9 Claims, 8 Drawing Sheets

IMAGE FORMING APPARATUS FOR CORRECTING IMAGE FORMATION CONDITION

CROSS-REFERENCE TO THE RELATED APPLICATION(S)

This application is based upon and claims priority from prior Japanese Patent Application No. 2005-286454 filed on Sep. 30, 2005, the entire contents of which are incorporated herein by reference.

TECHNICAL FIELD

The present invention relates to an image forming apparatus which forms an image by forming an electrostatic latent image on an image carrying body, developing it by sticking a developer on the image carrying body, and transferring the developer to a recording subject medium.

BACKGROUND

Image forming apparatus are known which form an electrostatic latent image on the surface of an image carrying body such as a photoreceptor drum that is charged uniformly in advance by, for example, exposing the image carrying body surface to light, develop the electrostatic latent image by sticking a developer such as charged toner on it, and transfer the developer to a recording subject medium such as a recording sheet. As for image forming apparatus of this type, it is pointed out that in the case where a non-magnetic, one-component toner is used as the developer in such a manner as to be friction-charged, the toner deteriorates and its charging characteristic varies as image formation is performed repeatedly. In view of this, in image forming apparatus of this type, it has been proposed to change the development bias in accordance with the number of printed sheets, as disclosed in JP-A-2003-173074

SUMMARY

However, in image forming apparatus of the above type, a study of the present applicant has proved that the characteristics of a developer depend on whether an image forming job is started again after the apparatus has been left inactive for a long time or an image forming job is carried out continuously. Therefore, where the development bias is changed only in accordance with the number of printed sheets as proposed in the above patent document, when an image formatting job is started again after a suspension, the image density may deviate from a desired value at least transiently. Such deviation of the image density from a desired value is a serious problem particularly in multi-color image forming apparatus such as color printers because it varies the hue of an image.

Another possible method is such that an image formation condition (e.g., a development bias) capable of attaining a desired density is set by forming a patch when necessary. However, if a large difference exists between a density of a patch formed and a preset target density, a deviation from a desired density may occur. That is, even in the case of forming a patch, it is required to set an image formation condition in advance so that a patch image density Close to a desired density will be obtained.

Aspects of the invention provide an image forming apparatus capable of performing image formation satisfactorily even in the case where an image forming job is started again after a suspension.

According to an aspect of the invention, there is provided an image forming apparatus including: an image forming unit that forms an image by forming an electrostatic latent image on an image carrying body, developing the electrostatic latent image by sticking a developer on the image carrying body, and transferring the developer to a recording subject medium; a suspension time calculating unit that calculates a suspension time for which image formation by the image forming unit is suspended; and a correction amount calculating unit that calculates a correction amount for an image formation condition of the image forming unit based on the suspension time calculated by the suspension time calculating unit.

According to the above aspect of the invention, the image forming unit forms an image by forming an electrostatic latent image on an image carrying body, developing the electrostatic latent image by sticking a developer on the image carrying body, and transferring the developer to a recording subject medium. The suspension time calculating unit calculates a suspension time for which image formation by the image forming unit has been suspended, and the correction amount calculating unit calculates a correction amount for an image formation condition of the image forming unit on the basis of the calculated suspension time, As described above, according to the invention, since a correction amount for the image formation condition is calculated on the basis of a suspension time, image formation can be performed satisfactorily by taking into consideration influences of a suspension of image formation and standing of the apparatus and a transitional characteristic variation that occurs when image formation is restarted after the suspension, by performing image formation in accordance with the calculated correction amount.

According to another aspect of the invention, there is provided an image forming apparatus including, an image forming unit that forms an image by forming an electrostatic latent image on an image carrying body, developing the electrostatic latent image by sticking a developer on the image carrying body, and transferring the developer to a recording subject medium; an image forming state detecting unit that detects an image forming state of the image forming unit; an image formation condition calculating unit that calculates an image formation condition of the image forming unit that corresponds to the image forming state detected by the image forming state detecting unit; a cumulatively counting unit that counts a first characteristic value indicating the number of times of image formation by the image forming unit as a cumulative value, which is irrelevant to occurrence/non-occurrence of a suspension of image formation; a first correction amount calculating unit that calculates a first correction amount for the image formation condition based on the first characteristic value counted by the cumulatively counting unit; a consecutively counting unit that counts a second characteristic value indicating the number of times images is formed consecutively by the image forming unit without a suspension; a suspension time calculating unit that calculates a suspension time for which image formation by the image forming unit has been suspended; a second characteristic value correcting unit that corrects the second characteristic value counted by the consecutively counting unit based on the suspension time calculated by the suspension time calculating unit; and a second correction amount calculating unit that calculates a second correction amount for the image formation condition based on the second characteristic value corrected by the second characteristic value correcting unit.

According to the above aspect of the invention, the image forming unit forms an image by forming an electrostatic latent image on an image carrying body, developing the electrostatic latent image by sticking a developer on the image carrying body, and transferring the developer to a recording subject medium. The image forming state detecting unit detects an image forming state of the image forming unit, and the image formation condition calculating unit calculates, on the basis of the detected image forming state, an image formation condition of the image forming unit that corresponds to the image forming state. Since an image formation condition is calculated on the basis of an image forming state detected by the image forming state detecting unit detects, image formation can be performed satisfactorily by the image forming unit by forming an image on the basis of the calculated image formation condition.

According to the above aspect of the invention, the cumulatively counting unit counts a first characteristic value indicating the number of times of image formation by the image forming unit as a cumulative value which is irrelevant to occurrence/non-occurrence of a suspension of image formation, and the first correction amount calculating unit calculates a first correction amount for the image formation condition on the basis of the counted first characteristic value. Furthermore, in the invention, the consecutively counting unit counts a second characteristic value indicating the number of times images have been formed consecutively by the image forming unit without a suspension, the suspension time calculating unit calculates a suspension time for which image formation by the image forming unit has been suspended, and the second characteristic value correcting unit corrects the counted second characteristic value on the basis of the suspension time calculated by the suspension time calculating unit. The second correction amount calculating unit calculates a second correction amount for the image formation condition on the basis of the second characteristic value corrected by the second characteristic value correcting unit.

Correcting the image formation condition on the basis of the thus-calculated first and second correction amounts makes it possible to perform image formation more satisfactorily by taking into consideration influences of a suspension of image formation and standing of the apparatus, a transitional characteristic variation that occurs when image formation is restarted after the suspension, and a cumulative number of times of image formation which is independent of whether a suspension occurred. In addition, since the image formation condition is corrected in accordance with the suspension time in the form of a correction for the second characteristic value, the processing can be simplified more, which provides, for example, an advantage that it is not necessary to prepare a complex table to deal with the suspension time. Furthermore, according to the invention, since the image forming state detecting unit can detect an image forming state after adjusting the image formation condition in advance on the basis of the first and second correction amounts, the image formation condition can be adjusted to a proper value more satisfactorily.

DETAILED DESCRIPTION OF THE ILLUSTRATIVE ASPECTS

Figure 1:
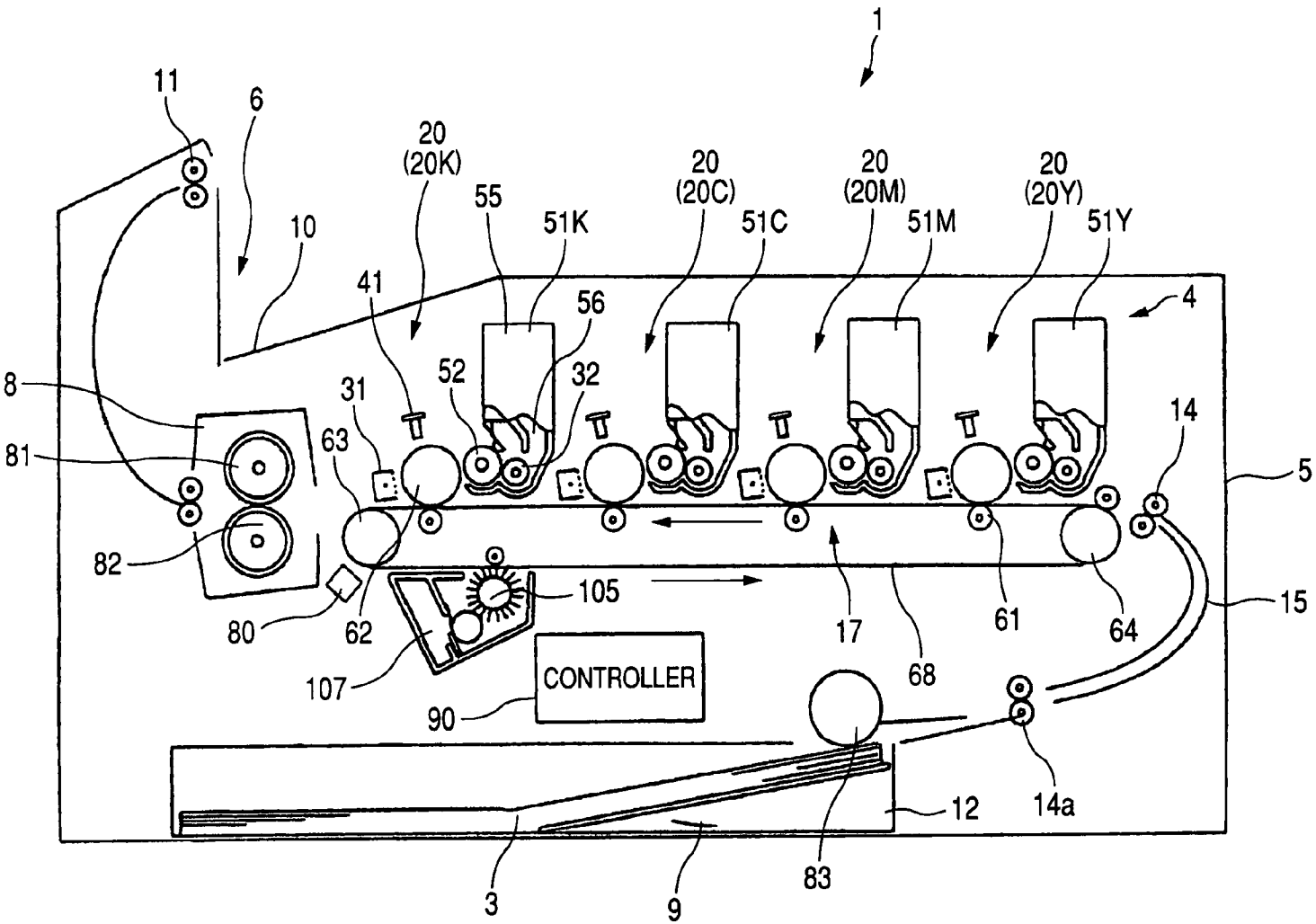
FIG. 1 is a sectional view showing the general configuration of an electrophotographic color printer to which the present invention is applied.

An aspect of the present invention will be hereinafter described with reference to the drawings. FIG. 1 is a sectional view showing the general configuration of an electrophotographic color printer 1 to which the invention is applied. As shown in FIG. 1, the electrophotographic color printer 1 is what is called a horizontal tandem electrophotographic color printer in which four image forming units 20 are arranged in the horizontal direction. A sheet supply unit 9 for supplying a recording sheet 3 as a recording subject medium, an image forming unit 4 for forming an image on the recording sheet 3 supplied, a sheet ejecting unit 6 for ejecting the image-formed recording sheet 3, and a control unit 90 for controlling operation of the electrophotographic color printer 1 are provided in a main body casing 5.

The sheet supply unit 9 is equipped with a sheet supply tray 12 which is inserted in the main body casing 5 from the front side (right side in FIG. 1) in a detachable manner, a sheet feed roller 83 which is disposed over one end portion (i.e., over the front end portion) of the sheet supply tray 12, and transport roller pairs 14*a* and 14*b* which are disposed on the front side of the sheet feed roller 83, that is, downstream of the sheet feed roller 83 in the recording sheet 3 transport direction (in the following description, the terms "downstream in the recording sheet 3 transport direction" and "upstream in the recording sheet 3 transport direction" may be abbreviated as "downstream" and "upstream," respectively)

Recording sheets 3 are stacked in the sheet supply tray 12. And the top recording sheet 3 is fed toward the transport roller pairs 14*a* and 14*b* one sheet at a time as the sheet feed roller 83 rotates. The sheet 3 thus fed is sent to transfer positions between a transport belt 68 and respective photoreceptor drums 62 in order.

A guide member 15 which extend in the vertical direction is disposed between the transport roller pairs 14*a* and 14*b*. A recording sheet 3 that has been fed by the sheet feed roller 83 is sent to the transfer positions between the transport belt 68 and the respective photoreceptor drums 62 in order by the transport roller pair 14*a*, the guide member 15, and the transport roller pair 14*b*.

The image forming unit 4, which is an intermediate section in the main body casing 5, is equipped with the four image forming units 20Y, 20M, 20C, and 20K for forming images, a transfer unit 17 for transferring the images formed by the respective image forming units 20 to a recording sheet 3, and a fusing unit 8 for fusing the transferred images onto the recording sheet 3 through heating and pressure application. The suffixes Y, M, C, and K mean yellow, magenta, cyan, and black, respectively, and will be omitted if it is not necessary to discriminate them from each other.

Each image forming unit 20 is configured in such a manner that a charger 31 for charging the photoreceptor drum 62, an exposure unit 41 as an electrostatic latent image forming unit for forming an electrostatic latent image on the photoreceptor drum 62, and a developing unit 51 as a developing unit for forming a toner image by sticking toner as a developer on the photoreceptor drum 62 using a development bias applied between itself and the photoreceptor drum 62 are disposed around the photoreceptor drum 62 as an image carrying body.

The charger 31 is a positively charging scorotron charger for charging the surface of the photoreceptor drum 62 positively and uniformly by causing a corona discharge from a charging wire made of tungsten or the like. For example, the exposure unit 41 includes an LED array for generating light to be used for forming an electrostatic latent image on the surface of the photoreceptor drum 62.

Light emitted from the LED array of the exposure unit 41 is applied to the photoreceptor drum 62, whereby an electrostatic latent image is formed on the surface of the photoreceptor drum 62. The exposure unit 41 need not always employ the LED array. For example, the exposure unit 41 may employ an exposure scanning unit (laser scanner) for exposing the photoreceptor drum 62 to light by scanning it with laser light.

The developing unit 51 is equipped with a hopper 56, a supply roller 32, and a developing roller 52 in a development casing 55. The hopper 56 is an internal space of the development casing 55. Yellow (Y), magenta (M), cyan (C), and black (K) toners (e.g., positively chargeable, non-magnetic, one-component polymerized toners) are accommodated in the hoppers 56 of the image forming units 20, respectively.

That is, the four image forming units 20 are the image forming unit 20Y in which a yellow (Y) toner is accommodated in the hopper 56, the image forming unit 20M in which a magenta (M) toner is accommodated in the hopper 56, the image forming unit 20C in which a cyan (C) toner is accommodated in the hopper 56, and the image forming unit 20K in which a black (B) toner is accommodated in the hopper 56. The four image forming units 20 have the same structure except for only the toner color (part of related reference symbols are omitted in FIG. 1).

The supply roller 32, which is disposed at a bottom position in the hopper 56, is configured in such a manner that a metal roller shaft is covered with a roller portion which is a conductive sponge member. The supply roller 32 is supported rotatably so as to move in a direction opposite to a rotation direction of the developing roller 52 in the nip portion where the supply roller 32 is opposed to and is in contact with the developing roller 52.

The developing roller 52 is disposed rotatably beside the supply roller at such a position as to be opposed to and be in contact with the supply roller 32. The developing roller 52 is configured in such a manner that a metal roller shaft is covered with a roller portion which is an elastic member made of a conductive rubber material or the like. As described later, a prescribed development bias voltage is applied to the developing roller 52 from a power source 110 (see FIG. 2).

The transfer unit 17 is provided so as to be opposed to the photoreceptor drums 62 in the main body casing 5. The transfer unit 17 is equipped with a transport belt drive roller 63, a transport belt follower roller 64, the transfer belt 68 which is an endless belt, and transfer rollers 61.

The transport belt follower roller 64 is disposed upstream of (on the front side of) the photoreceptor drum 62 of the yellow image forming unit 20Y which is located upstream of the other image forming units in the recording sheet 3 transport direction. And the transport belt follower roller 64 is disposed above and on the front side of the sheet feed roller 83. The transport belt drive roller 63 is disposed downstream of (on the back side of) the black image forming unit 20K which is located downstream of the other image forming units in the recording sheet 3 transport direction. And the transport belt drive roller 63 is disposed upstream of (on the front side of) the fusing unit 8.

The transport belt 68 is stretched between and wound on the transport belt drive roller 63 and the transport belt follower roller 64. The thus-wound transport belt 68 is disposed in such a manner that its outer surface is opposed to and brought into contact with the photoreceptor drums 62 of all the image forming units 20.

As the transport belt drive roller 63 is driven, the transport belt follower roller 64 follows the rotation of the transport belt drive roller 63 and the transport belt 68 circulates counterclockwise between the transport belt drive roller 63 and the transport belt follower roller 64. That is, the transport belt 68 is moved in the same direction as the photoreceptor drums 62 in the contact portions where the transport belt 68 is opposed to and brought into contact with the photoreceptor drums 62 of the image forming units 20, respectively.

The transfer rollers 61 are disposed inside the wound transport belt 68 so as to be opposed to the photoreceptor drums 62 of the image forming units 20 via the transport belt 68, respectively. Each transfer roller 61 is configured in such a manner that a metal roller shaft is covered with a roller portion which is an elastic member made of a conductive rubber material or the like.

The transfer rollers 61 are provided so as to be rotatable counterclockwise so that they rotate in the same direction as the circulation direction of the transport belt 68 in the contact portions where they are opposed to and brought into contact with the transport belt 68. A prescribed voltage is applied from a power source (not shown) between each transfer roller 61 and the associated photoreceptor drum 62 in such a polarity that a toner image carried by the photoreceptor drum 62 is transferred to a recording sheet during a transfer (i.e., a proper transfer bias is applied by a constant current control)

The fusing unit 8 is disposed downstream of (on the back side of) the image forming units 20 and the transfer unit 17. The fusing unit 8 is equipped with a heating roller 81 and a pressing roller 82. The heating roller 81 is a metal pipe on whose surface a mold release layer is formed and inside which a halogen lamp is disposed along its axis. The heating roller 81 is heated by the halogen lamp so that the temperature of its surface is increased to a fusing temperature. The pressing roller 82 is disposed so as to be pressed against the heating roller 81.

The sheet ejecting unit 6 occupies a top portion of the main body casing 5 and is disposed downstream of the fusing unit 8. The sheet ejecting unit 6 is equipped with a pair of sheet ejection rollers 11 for ejecting an image-fused recording sheet 3 onto a sheet ejection tray 10 and the sheet ejection tray 10 which is disposed downstream of the sheet ejection rollers 11 and serves to accumulate recording sheets 3 that have been fully subjected to an image forming process.

A density sensor 80 for reading a patch or the like formed on the transport belt 68 is disposed below (obliquely behind) the transport belt drive roller 63 so as to be opposed to the outer surface of the transport belt 68. A toner collector 107 for collecting toner (of the above-mentioned patch or the like) stuck to the transport belt 68 is disposed below (obliquely in front of) the transport belt drive roller 63 in such a manner that a toner collection roller 105 of the toner collector 107 is brought into contact with the outer surface of the transport belt 105.

Figure 2:
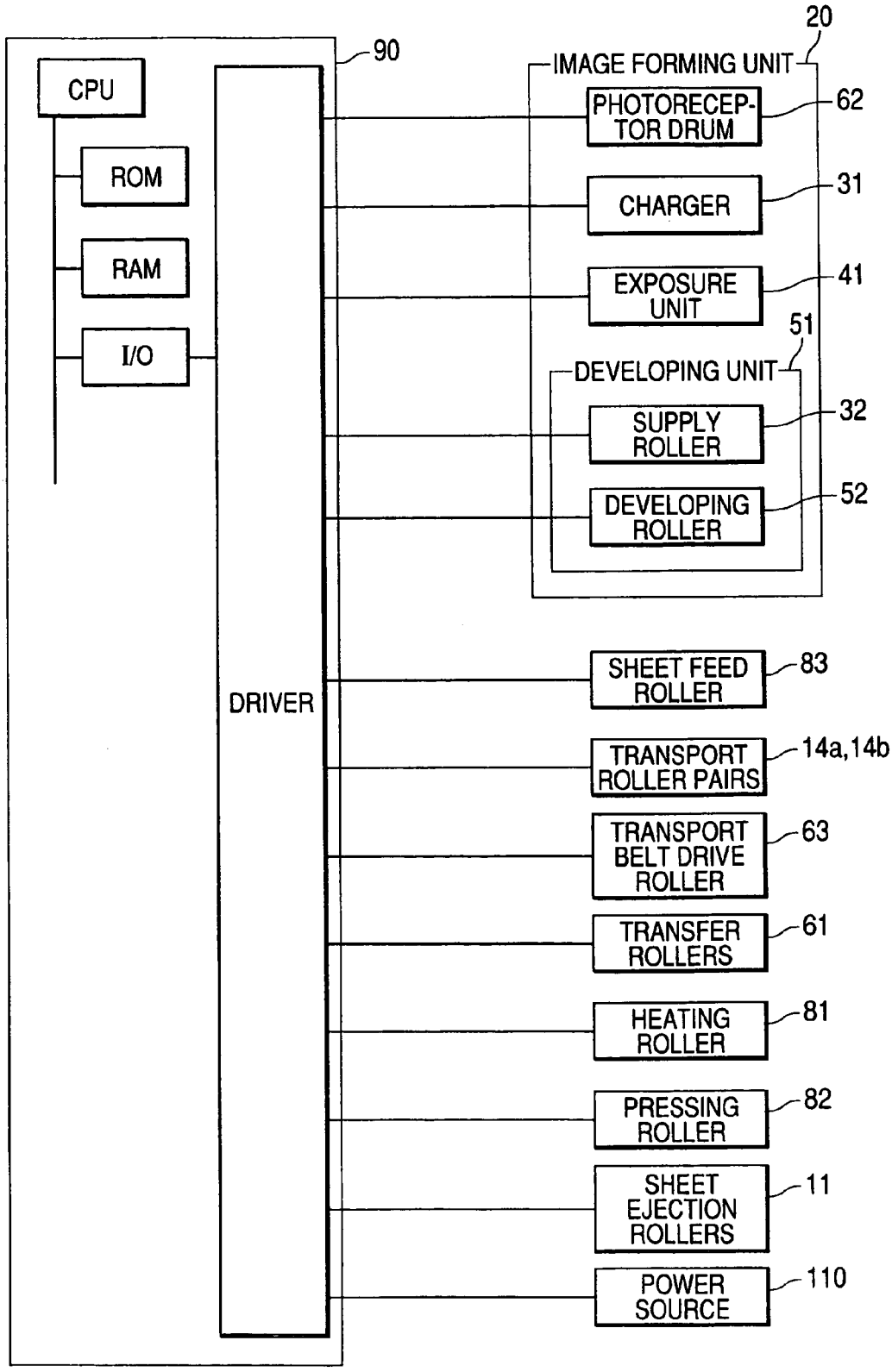
FIG. 2 is a block diagram schematically showing the electrical configuration of the electrophotographic color printer.

Next, a process by which the electrophotographic color printer 1 forms a color image on a recording sheet 3 through cooperative operations of the above-described units provided inside the apparatus will be described while the electrical configuration of the electrophotographic color printer 1 will be describe with reference to FIG. 2. FIG. 2 is a block diagram schematically showing the electrical configuration of the electrophotographic color printer 1.

As shown in FIG. 2, the electrophotographic color printer 1 is equipped with the controller 90 incorporating a CPU, a ROM, a RAM, I/O interfaces, a driver, etc., and is configured in such a manner that the controller 90 performs an ordinary image forming operation, calculation of a correction amount for an image formation condition in an image forming operation, and other operations.

In an ordinary image forming operation, after making, by means of a main control processing unit (program), initial settings of individual units of the apparatus to be controlled during image formation, the controller 90 of the electrophotographic color printer 1 charges the surface of each photoreceptor drum 62 uniformly with the associated charger 31 and forms an electrostatic latent image on the surface of the photoreceptor drum 62 by causing the associated exposure unit 41 to illuminate it with light according to image information. Then, the controller 90 develops the electrostatic latent image formed on the surface of the photoreceptor drum 62 by sticking toner on the surface of the photoreceptor drum 62 with the developing unit 51. The controller 90 moves the developed toner image to the transfer position as the photoreceptor drum 62 is rotated.

The controller 90 feeds a recording sheet 3 to the transport belt 68 by operating the sheet feed roller 83 and the transport roller pairs 14*a* and 14*b*. The controller 90 supplies the recording sheet 3 to the transfer positions by circulating the transport belt 68 by driving the transport belt drive roller 63. At each transfer position, the controller 90 transfers a toner image (described above) to the recording sheet 3 by applying a transfer bias between the transfer roller 61 and the photoreceptor drum 62.

Then, the controller 90 transports the recording sheet 3 to the fusing unit 8 by circulating the transport belt 68. In the fusing unit 8, the controller 90 causes the heating roller 81 and the pressing roller 82 to transport the recording sheet 3 while holding it between themselves to thereby fuse the toner images onto the recording sheet 3 by heating and applying pressure to the toner images. Then, the controller 90 ejects the recording sheet 3 onto the ejection tray 10 which is the top portion of the main body casing 5 by operating the sheet ejection rollers 11. The image forming operation is thus finished.

The electrophotographic color printer 1 forms an image on a recording sheet 3 by an image forming operation as described above. However, in electrophotographic color printers such as the electrophotographic color printer 1 which are of such a type as to form an image using toners, as the number of times of image formation increases, the density of an image formed on a recording sheet 3 varies due to various factors such as deterioration of the toners.

More specifically, as the toner to be stuck to each photoreceptor drum 62 deteriorates, the charging capability of the toner lowers gradually. Therefore, if image formation is continued with a constant development bias applied to each developing roller 52, the amount of toner that is moved from the developing roller 52 to the photoreceptor drum 62 and stuck to the photoreceptor drum 62 increases, as a result of which the image formed on a recording sheet 3 becomes denser gradually. If an image forming job is started again after a suspension of a sufficient time during which the electrophotographic color printer 1 was left inactive, a transitional variation occurs in image density immediately after the restart of the image forming job.

The above phenomena will be described below by using experimental data. In the following description, image formation maybe referred to as "printing." The term "printing" is not limited to an operation of forming a text image and includes all kinds of general image forming operations.

First, we investigated how the image density varies when printing is performed continuously with a constant development bias from a state that the apparatus has been left inactive for a sufficient time. As represented by a curve D(N) in FIG. 3, first the image density increases steeply with respect to the number of times of image formation and finally comes to increase at a constant rate. If an operation that printing is started again after a suspension of a sufficient time during which the apparatus is left inactive is repeated thereafter, as shown in FIG. 4 the image density gradually increases while exhibiting a characteristic that in each operation the image density increases starting from a value lower than a value immediately before the standing of the apparatus.

The above characteristic of image density increase can be analyzed by separating it into a long-term characteristic that the image density gradually increases with the number of times of printing and a short-term characteristic that the image density increases steeply with the number of times of printing after standing of the apparatus.

The long-term characteristic is represented by a function Dg(N) of the total number N of sheets printed by the apparatus. The long-term characteristic has a feature that the image density increases gradually as printing is repeated. This is considered due to deterioration of the toner, deterioration of the photoreceptor drum 62, deterioration and staining of the apparatus, etc. The short-term characteristic is represented by a function Df(N) of the number M of sheets printed consecutively after standing of the apparatus of a sufficient time. The short-term characteristic has a feature that the image density increases steeply upon the start of printing but does not vary after the apparatus is rendered in a stationary state. This is considered due to temporary variations in the characteristics of the toner and the photoreceptor drum 62 that are caused by the repetition of printing. Refer to a curve Df(N) in FIG. 3 which represents only the short-term characteristic.

The image density varies in the above-described manner every time printing is performed, which is a problem relating to the image quality. In particular, in the case of electrophotographic color printers like the one according to this aspect, this is a serious problem because density variations appear in the form of a color variation. Therefore, particularly in electrophotographic color printers, it is necessary to perform controls so that the densities are kept constant.

Figure 5:
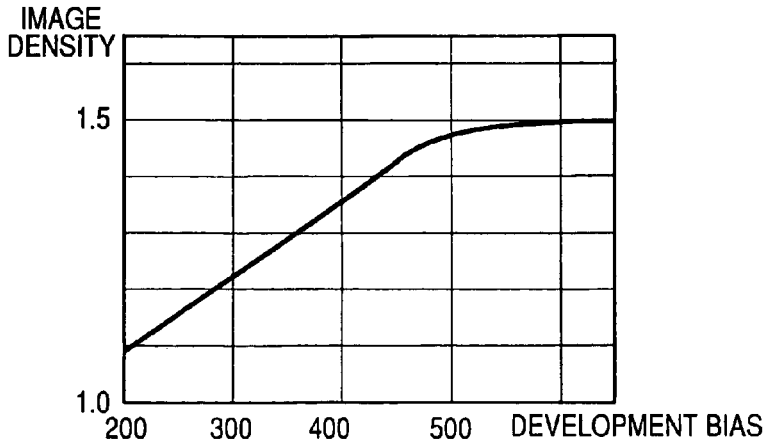
FIG. 5 is a graph showing a relationship between the development bias and the image density.

One method for controlling the image density is to control the development bias. Toner is attracted by the surface of the photoreceptor drum 62 because of the difference between the potential of an electrostatic latent image formed on the photoreceptor drum 62 by exposure to light and the potential (development bias) of the developing roller 52. Therefore, the amount of toner that is moved to the photoreceptor drum 62 can be controlled by changing the development bias. FIG. 5 shows a relationship between the development bias and the image density. That is, the image density increases as the development bias increases. However, in a development bias range higher than a certain value (600 V in the example of FIG. 5), the image density is saturated and kept approximately constant because of an upper limit of the amount of toner that can be carried by the development roller 52.

Figure 6:
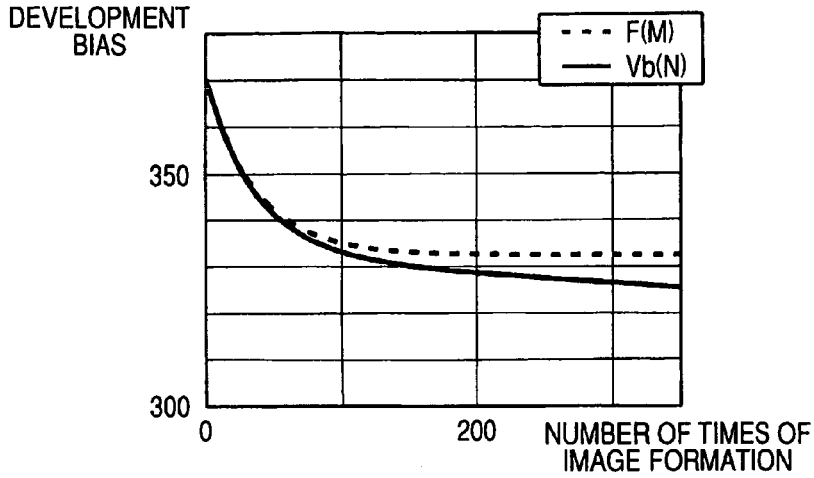
FIG. 6 is a graph showing a development bias control characteristic for keeping the image density constant, which corresponds to the characteristic of FIG. 3.
Figure 7:
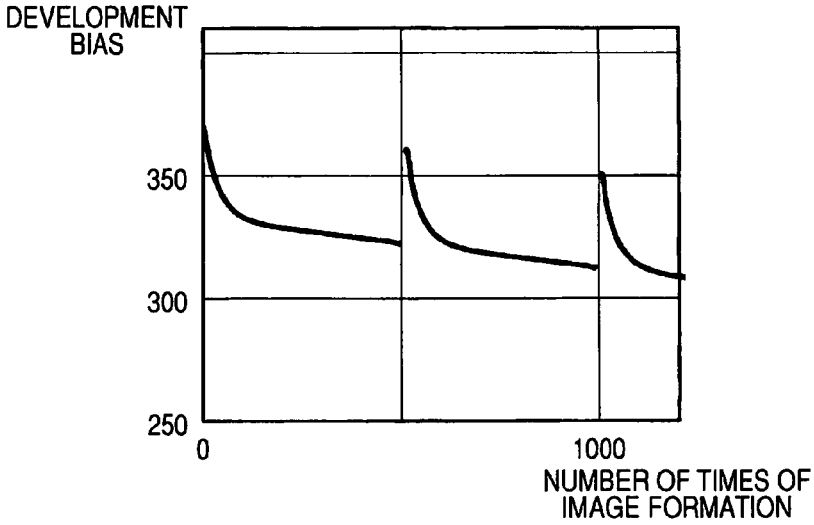
FIG. 7 is a graph showing a development bias control characteristic for keeping the image density constant, which corresponds to the characteristic of FIG. 4.

In a range where the image density is not saturated, the image density can be controlled in such a manner that the development bias is decreased it the image density is high and increased if the image density is low. FIGS. 6 and 7 show development bias control characteristics for keeping the image density constant, which are obtained by applying this control to the density variation characteristics of FIGS. 3 and 4, respectively.

Figure 3:
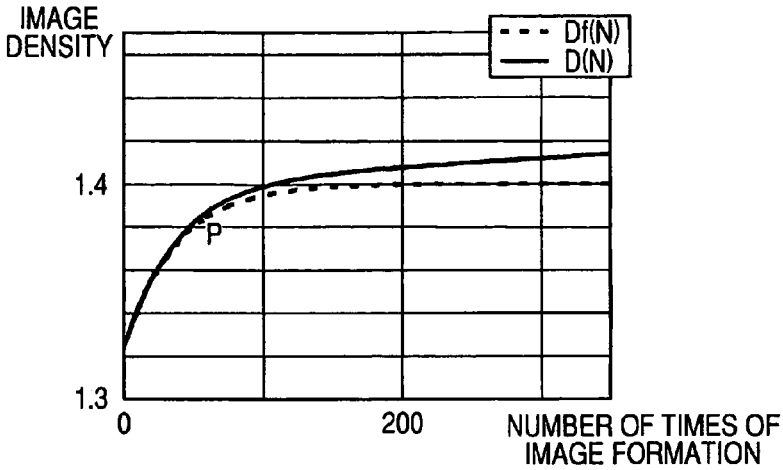
FIG. 3 is a graph showing how the image density varies as printing is performed continuously with a constant development bias after the apparatus has been left inactive for a sufficient time.
Figure 4:
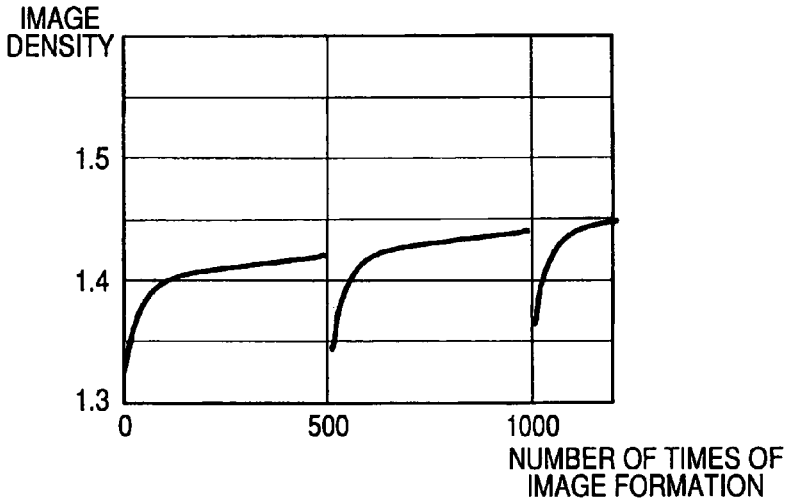
FIG. 4 is a graph showing how the image density varies as an operation that printing is started again after a suspension of a sufficient time during which the apparatus is left inactive is repeated.

As seen from FIGS. 6 and 7, the development bias control characteristics are close to inverted versions of the characteristics of FIGS. 3 and 4. Therefore, the development bias control characteristic can be analyzed in the same manner as the density variation characteristic was done above. That is, the development bias control characteristic can be analyzed by separating it into a long-term characteristic in which the development bias is lowered gradually with the number of times of printing and a short-term characteristic in which the development bias is lowered rapidly with the number of times of printing.

Therefore, the development bias Vb for keeping the image density constant is given by the following equation:

$$Vb(N, M)=Vo-g(N)-f(M)$$

where the function g(N) of the total number of sheets printed by the apparatus represents the long-term characteristic and the function f(M) of the numbers of sheets printed consecutively after standing of the apparatus of a sufficient time represents the short-term characteristic.

Next, consideration will be given to the long-term characteristic g(N) and the short-term characteristic f(M). First, the long-term characteristic g(N) is a term indicating how to change the development bias as the apparatus including the toner, the photoreceptor drum 62, etc. deteriorates. In this term, deterioration of the toner (in terms of a measurement quantity, a variation in the amount of charge carried by the toner) is the main cause of an image density variation.

Since how the toner deterioration proceeds depends on how a printer user uses the apparatus, it is difficult to completely predict how the image density will vary. To realize an accurate control, a method of detecting how the toner is deteriorating and performing a control on the basis of a detection value is effective. However, this method requires a sensor and hence unavoidably complicates the system and increases the cost. In view of this, although the control accuracy is somewhat lowered, this aspect employs a method of lowering the development bias at a fixed rate (slope). The long-term characteristic g(N) is thus given by the following equation:

$$g(N)=\alpha N$$

where $\alpha$ is a constant.

Next, consideration will be given to the short-term characteristic f(M). The shape of the curve representing the short-term characteristic f(M) is such that the development bias converges to a certain value as printing is continued according to the curve F(M) shown in FIG. 6 which corresponds to the curve Df(N) shown in FIG. 3. Therefore, the short-term characteristic f(M) is given by the following equation:

$$f(M)=A\{1-\exp(-BM)\}$$

where A and B are constants.

Figure 8:
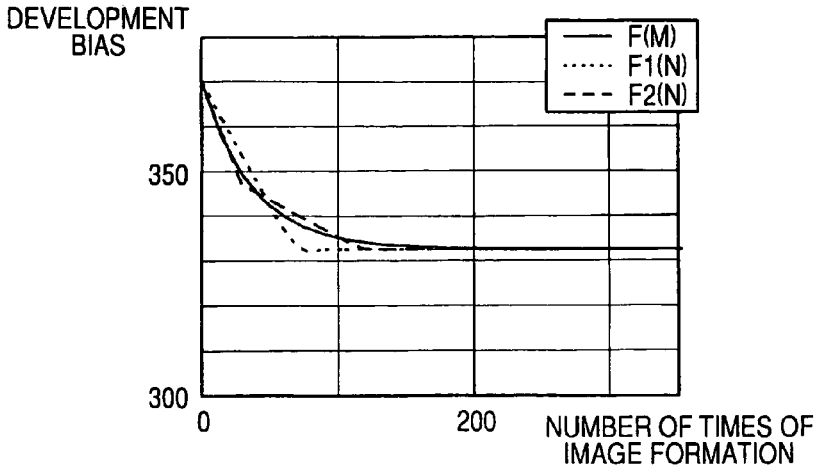
FIG. 8 is a graph showing short-term characteristics of the development bias control each of which is a straight-line approximation.

However, this kind of exponential calculation imposes a heavy load on the CPU of the controller 90. Since a development bias is generally determined immediately before actual formation of an image, if a heavy load is imposed on the CPU and processing of determining a development bias thereby takes long time, an adverse influence such as a failure of access to image data to be printed may occur in image formation. In view of this, in this aspect, the above exponential function is approximated by straight lines. In FIG. 8, a curve F1(M) shows a method of approximating the curve F(M) shown in FIG. 6 by two straight lines and a curve F2(M) shows a method of approximating the curve F(M) by three straight lines. The control accuracy may be increased by approximating the curve F(M) by more straight lines.

Figure 9:
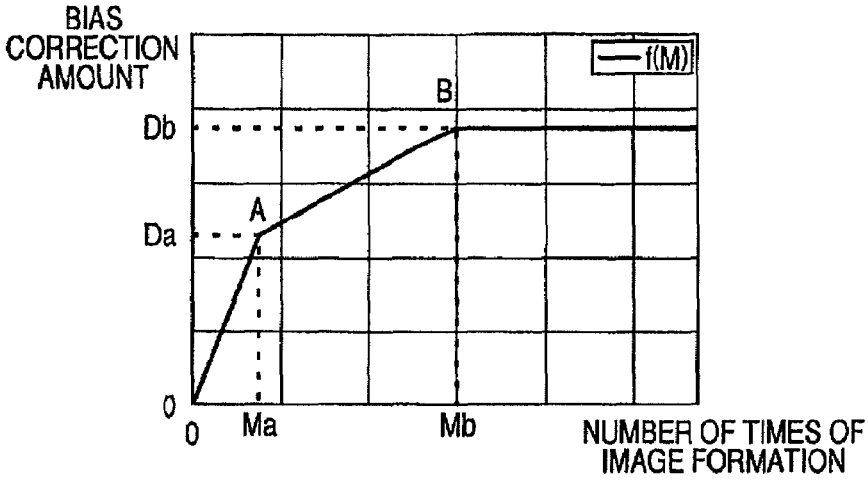
FIG. 9 is a graph showing a short-term characteristic of a development bias correction amount which is a straight-line approximation.

For example, where the curve F(M) is approximated by three straight lines, the short-term characteristic f(M) can be expressed as the following Formula 1. Refer to FIG. 9 which is a graph corresponding to Formula 1.

$$\begin{aligned} f(M) &= Vba*M/Ma \ (0 < M \le Ma) \\ &= Vba+(Vbb-Vba)*(M-Ma)/ \\ &\quad (Mb-Ma) \ (Ma < M \le Mb) \\ &= Vbb \ (Mb < M) \end{aligned} \qquad \text{Formula 1}$$

As described above, in this aspect, to keep the image density constant, a development bias is calculated according to the equation Vb(N, M)=Vo−αN−f(M).

Next, when printing is performed continuously after the apparatus has been left inactive for a sufficient time, the image density can be kept constant by using the above-described method. However, in actual use of the electrophotographic color printer 1, although there may occur a case that printing is performed continuously on hundreds of sheets, there may occur another type of operation that printing on several sheets or tens of sheets is repeated with a short suspension (i.e., the apparatus is not left inactive for a sufficient time). Therefore, it is desirable that the short-term characteristic f(M) take the form of f(M, t) which reflects the standing time t (corresponds to the suspension time) for which the apparatus is left inactive without performing image formation. To simplify the processing, this aspect employs a method of correcting the number N of consecutively printed sheets using the standing time t in the following manner.

It is expected the true function f(M, t) would be a complex function. On the other hand, for example, common methods of generating an f(M, t) table or determining a simple approximate formula off (M, t) make the processing unduly complex. For example, table data would be complex in the former method. In the latter method, a common approximate formula F(M, t)=f(M)*h(t) (h(t)=1 at t=0 and h(t)=0 when t is sufficiently large) is to be determined. However, it is expected that the function h(t) would be very complex.

In view of the above, this aspect employs a method that for m being the number of printed sheets at the end of the preceding print job, the number M of consecutively printed sheets at the start of the next print job is calculated according to M=h(t)*m+1. The function h(t) is such as to be equal to 1 at t=0 and equal to 0 when t is sufficiently large. In this aspect, to employ this method, the following items are assumed.

(1) The relationship between the number N of printed sheets in the case of a short-term density rise is given by the curve Df(N) shown in FIG. 3.

(2) Also in the case where a print job is started again after the image density has been lowered by leaving the apparatus inactive, the image density varies according to the curve Df(N) shown in FIG. 3. For example, assume that when the apparatus has been left inactive after printing was performed until the image density was saturated to have a value 1.4 in the curve Df(N) shown in FIG. 3, the image density has been lowered to 1.38 (point P). Assume that the number printed sheets at this timepoint is 50. If a print job is started again from this state, the image density varies with the number of printed sheets according to part of the curve Df(N) shown in FIG. 3 that corresponds to the 51st and following sheets.

(3) Once the apparatus is rendered in a stationary state as a result of continuous printing, the image density varies in the same manner after standing of the apparatus irrespective of when the apparatus starts to be left inactive. That is, as shown in FIG. 3, after printing has been performed on 200 sheets, the image density of the curve Df(N) is kept at the stationary state value, that is, the image density remains the same even for N being equal to 300. It is assumed that the internal states of the apparatus remain the same as long as it is in a stationary state. It is therefore assumed that the image density varies in the same manner when the apparatus has been left inactive for one hour after printing on 200 sheets as when the apparatus has been left inactive for one hour after printing on 300 sheets.

(4) Under the condition (3), the function h(t) of a case that the apparatus was left inactive in a stationary state (density-saturated state) established by continuous printing is the same as the function h(t) of a case that the apparatus was left inactive in a non-stationary state.

Figure 10:
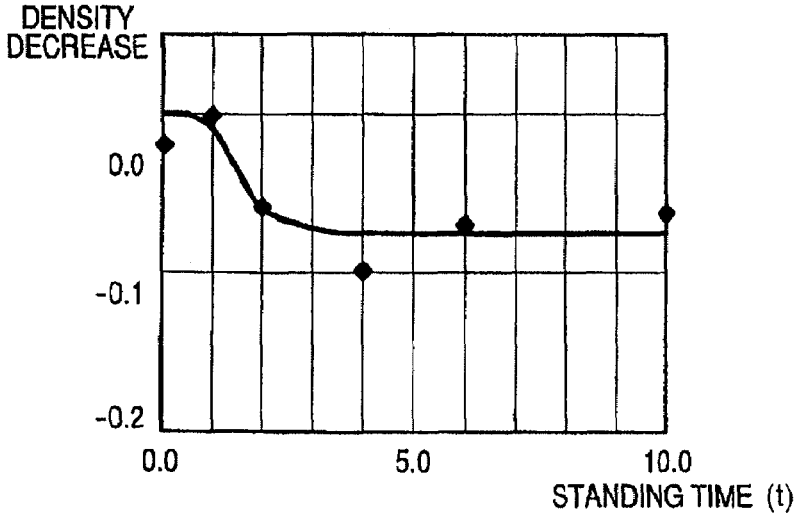
FIG. 10 is a graph showing a relationship between the standing time and the decrease from an image density at the end of a print job.
Figure 11:
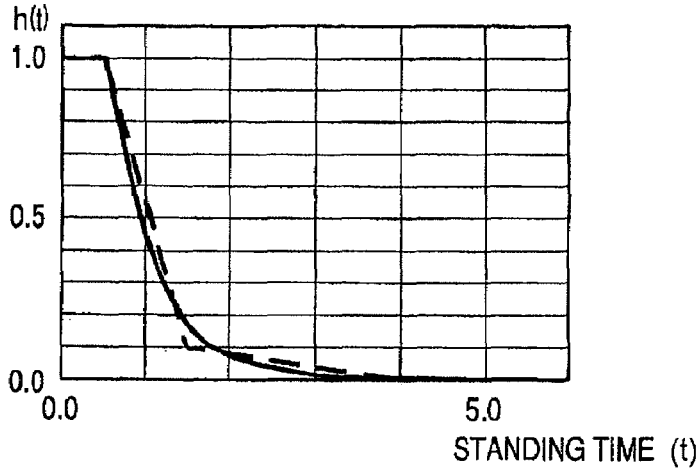
FIG. 11 is a graph showing a relationship between the standing time and a correction function h for the number M of consecutively printed sheets.

The condition (3) makes it possible to set an upper limit for M and thereby perform a control so that M does not become larger than a prescribed value. To determine the function h(t) on the basis of the above assumptions, the present applicant measured a relationship between the standing time and the decrease from a an image density at the end of a print job. A result is as shown in FIG. 10. As shown in FIG. 10, the density is maintained for a while after the end of a print job, then decreases, and comes not to decrease any more after a lapse of a prescribed time (i.e., a state is established that the apparatus has been left inactive for a sufficient time). The solid line in FIG. 11 shows a function h(t) obtained from this measurement result of the image density decrease using the curve Df(N) shown in FIG. 3. The broken-line curve in FIG. 11 is a straight-line approximation of the solid-line curve and can be expressed by the following equation:

$$\begin{aligned} h(t) &= 1 \ (0 \le t < T1) \\ &= 1 - (t - T1) * k1 \ (T1 \le t < T2) \\ &= 1 - (T2 - T1) * k1 - (t - T2) * k2 \ (T2 \le t < T3) \\ &= 0 \ (T3 \le t) \end{aligned} \qquad \text{Formula 2}$$

Figure 12:
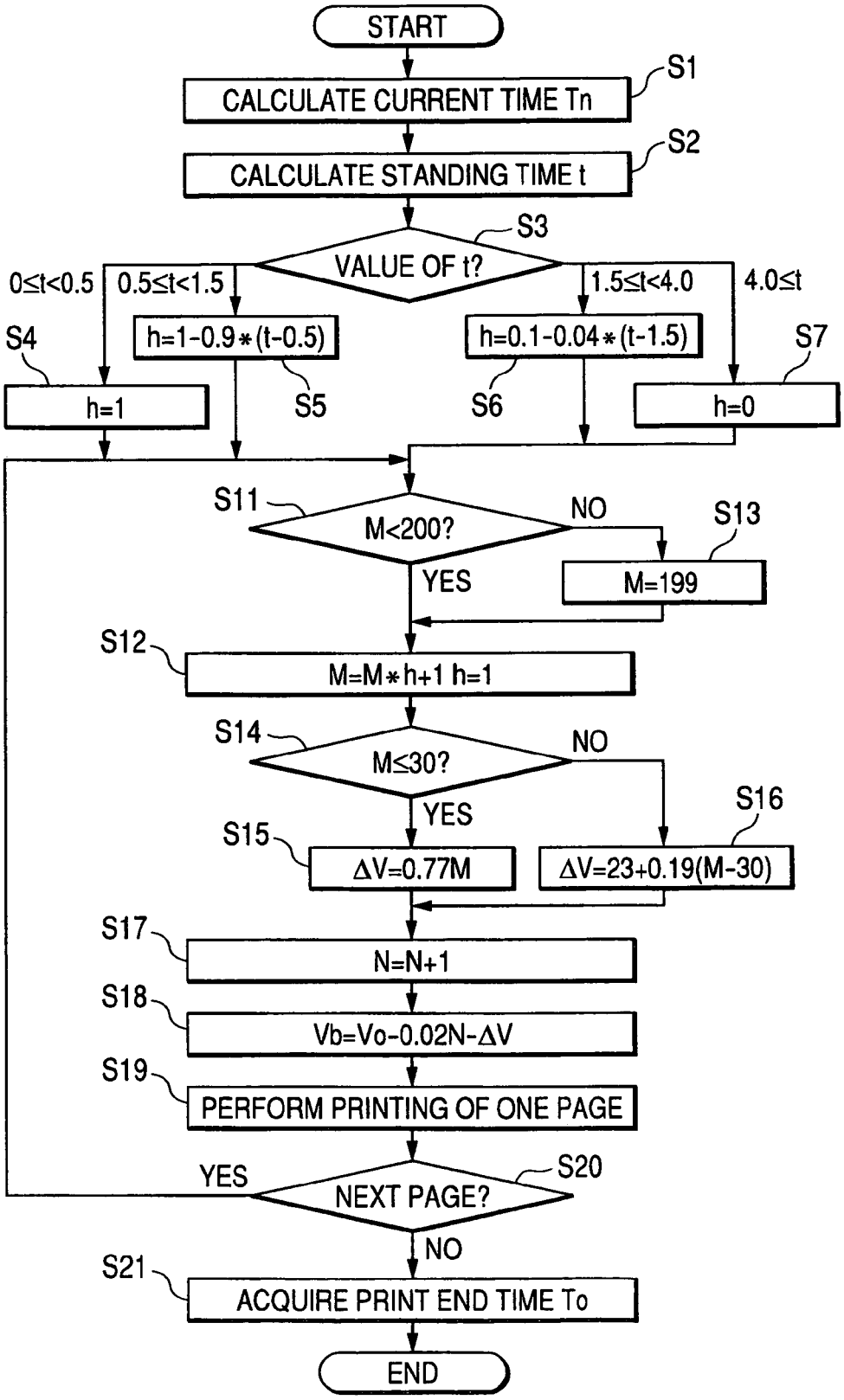
FIG. 12 is a flowchart of a printing process of the electrophotographic color printer.

Next, the control performed by the controller 90 will be described on the basis of the above consideration. FIG. 12 is a flowchart of a printing process which is executed by the controller 90 when it receives a print instruction from an external personal computer or the like. Upon a start of the process, at step S1, a current time Tn is acquired. The current time Tn may be acquired by a clock that is provided in the controller 90 or acquired from a personal computer or a server that is connected to a network. At the next step S2, a standing time t is calculated by calculating the difference between the current time Tn acquired at step S1 and a print end time To that was acquired at step S21 or S56 (described later) and is stored in the RAM or the like (it is desirable that the storage device be a nonvolatile one which can hold information even after turning-off of power).

At the next step S3, the value of t is judged. If 0≦t<0.5, h is set to "1" at step S4. If 0.5≦t<1.5, h is set to 1−0.9*(t−0.5) at step S5. If 1.5≦t<4.0, h is set to 0.1−0.04*(t−1.5) at step S6. If 4.0≦t, h is set to 0 at step S7. That is, h(t) is calculated according to a formula obtained by substituting T1=0.5, T2=1.5, T3=4.0, k1=0.9, and k2=0.04 into the above Formula 2. These coefficients etc. may be changed in accordance with the toner.

When the value of h is set at one of steps S4-S7, it is judged at the next step S11 whether or not the number M of consecutively printed sheets is smaller than 200. If M<200 (S11: Y), the process directly moves to step S12. If M≧200 (S11: N), M is set to 199 at step S13 and the process moves to step S12. At step S12, a new number M of consecutively printed sheets is calculated according to the above-mentioned equation M=M*h+1. As described above, the apparatus was in a stationary state if the number M of consecutively printed sheets is larger than 200. Therefore, in this case, M is set to 199 and then the number M of consecutively printed sheets is corrected according to the above standing time t. At step S12, a new number M of consecutively printed sheets is calculated according to the equation M=M*h+1 and then h is reset to "1." Therefore, when step S12 is executed second time or later (S20: Y; described later), the number M of consecutively printed sheets is merely incremented by "1."

At the next step S14, it is judged whether or not the number M of consecutively printed sheets as corrected at step S12 is smaller than or equal to 30. If M≦30 (S14: Y), ΔV is set to 0.77M at step S15. If M>30 (S14: N), ΔV is set to 23+0.19 (M−30) at step S16. Then, the process moves to step S17. This formula of ΔV corresponds to the short-term characteristic f(M, t) approximated by three straight lines, more specifically, it is a formula obtained by substituting Ma=30, Mb=200, Vba=23, and Vbb=55 into the above-described Formula 1.

At the next step S17, the total number N of printed sheets is incremented by "1" and the process moves to step S18. At step S18, a value obtained by subtracting the above-calculated ΔV and 0.02N from a reference development bias Vo that was calculated at step S54 (described later) and is stored in the RAM or the like is set as a development bias Vb. At the next step S19, printing of one page is performed with the development bias Vb. At step S20, it is judged whether or not the next page exists. If the next page exists (S20: Y), the process moves to step S11, rf the next page does not exist (i.e., all pages have been printed; S20: N), a current time is acquired as a print end time To at step S21 and the process is finished, Next, in the electrophotographic color printer 1 according to the aspect, when the power is turned on, printing has been performed on a prescribed number of sheets, or an instruction is input by a user through a panel (not shown) provided on the surface of the apparatus, a density correction process is executed in which a patch (i.e., a pattern image for density correction) is printed on the transport belt 68 and read by the density sensor 80. Although this process is the same as a known process in terms of the mechanical operation of the apparatus, to determine a reference development bias Vo from a detected patch density, it is necessary to know a state of the short-term characteristic f(M, t) at the time of detection of the patch. Therefore, in this process, ΔV is calculated in the same manner as in the above-described printing process.

Figure 13:
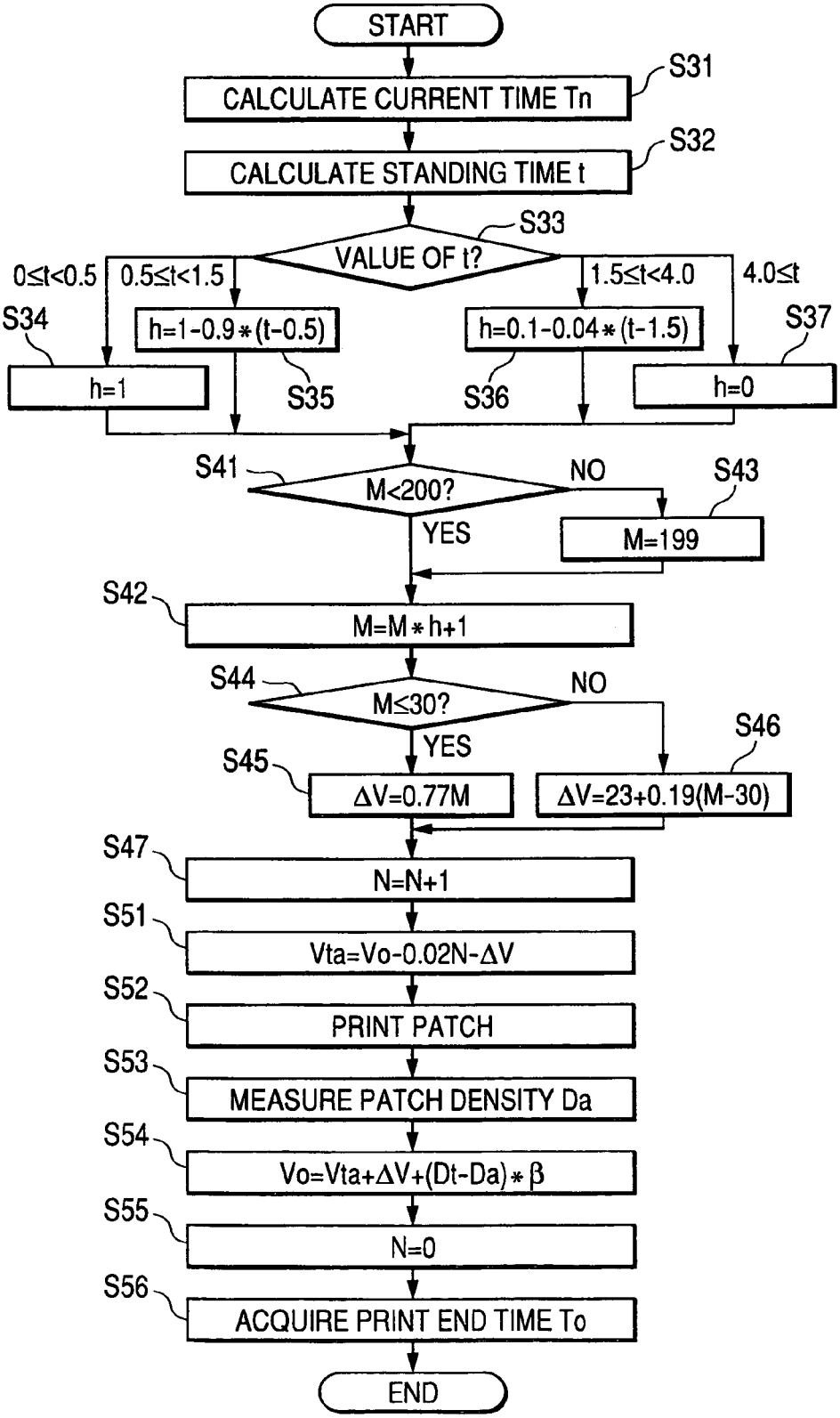
FIG. 13 is a flowchart of a density correction process of the electrophotographic color printer.

That is, as shown in a flowchart of FIG. 13, upon a start of the process, steps S31-S47 are executed which are the same as the above-described steps S1-S17. At the next step S51, a development bias Vta is calculated according to the same formula as used in calculating a development bias Vb at step S18. At step S52, a patch is printed with the calculated development bias Vta. At the next step S53, a patch density Da is measured. At the next step S54, a new reference development bias Vo (V) is calculated according to the following equation:

$$Vo = Vta + \Delta V + (Dt - Da) * \beta.$$

That is, a correction amount (Dt−Da)*β for the development bias is determined by calculating the difference between the measured density Da and a predetermined target density Dt and multiplying the difference by a correction control parameter β. A new reference development bias Vo (V) is determined by correcting, using the thus-determined correction amount, the development bias Vta that was used when the patch was printed and adding ΔV which corresponds to the short-term characteristic f(M, t). At the next step S55, the total number N of printed sheets is reset to "0." A print end time To is acquired at the next step S56 and the process is finished. In the printing process, at step S18, a development bias correction for keeping the image density constant is performed according to $$Vb=Vo-\alpha N-f(M, t)=Vo-0.02N-\Delta V$$

by using the reference development bias Vo (V) determined by this process. In this aspect, the valid/invalid switching of the function of executing the density correction process automatically when the power is turned on or every time printing has been performed on a prescribed number of sheets can be made by a manipulation through the panel. For example, where the apparatus is used in a constant environment as obtained in an office or the like, the density can be kept within a certain narrow range by an open-loop prediction control of the above-described printing process. Therefore, refraining from executing the density correction process at the time of application of power, for example, enables a quick boot of the apparatus and reduces the amount of waste toner because of omission of patch printing.

Figure 14:
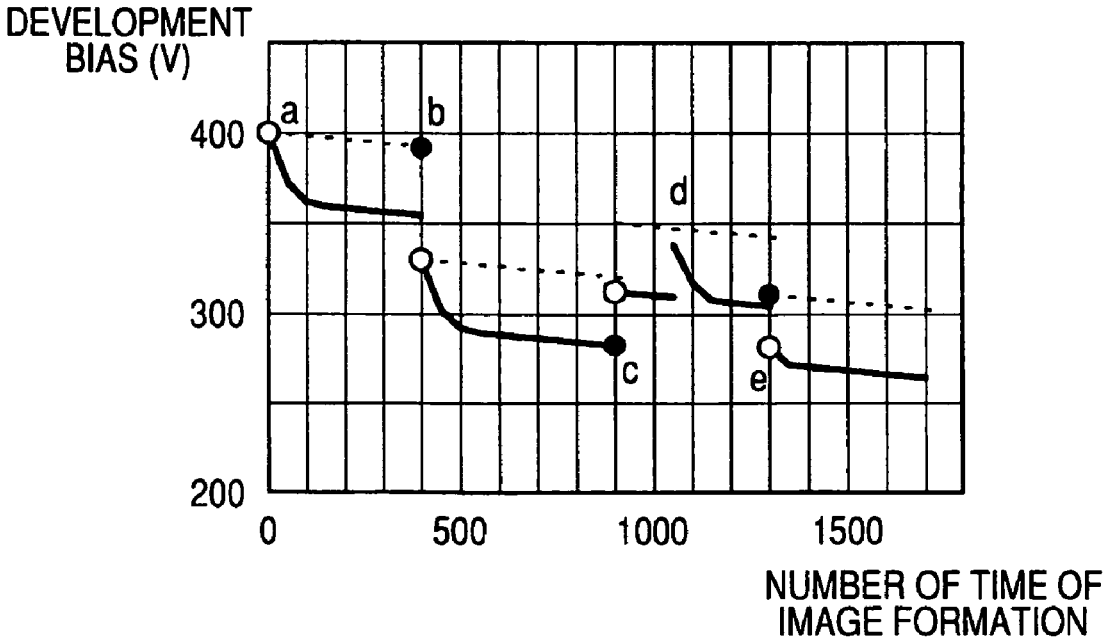
FIG. 14 is a graph showing an actual example of control using the above processes.

FIG. 14 is a graph showing an actual example of control. In this example of control, a patch is printed and a density correction is performed when the power is turned on or every time printing has been performed on a prescribed number of sheets (points a, b, c, and e in FIG. 14). When the power is turned on and a density correction is performed for the first time (point a in FIG. 14), a patch is formed with a prescribed development bias Vta (V) and a density of the thus-formed patch is measured by the density sensor 80, The long-term characteristic aN is a term for correcting for the deterioration of the apparatus including the toner, the photoreceptor drum 62, etc. In this aspect, the development bias is decreased at a constant rate with respect to the number of printed sheets. Therefore, the number N of printed sheets can be initialized to "0" (S55) when a density correction process is executed. As such, the control is simple.

When the power is applied to the apparatus for the first time, the short-term characteristic f(M, t) is calculated as the number M is incremented from "1." Therefore, the development bias Vb (indicated by a solid-line in FIG. 14) which is calculated at step S18 varies starting from a reference development bias (indicated by a white circle in FIG. 14) which is calculated by a density correction process. FIG. 14 shows an exemplary case that printing is performed consecutively on 399 sheets from the first application of power. Development bias variations due to only the long-term characteristic aN are also shown in FIG. 14 by broken lines).

Point b corresponds to a second density correction process which is executed when the power is turned on after the apparatus has been left inactive for a sufficient time since the power was turned off after the printing on 399 sheets. In this case, a patch is formed (S52) using a development bias Vta=Vo−α*400−0.77 (because N=400) and an image density of the thus-formed patch is measured by the density sensor 80. Then, a new reference development bias Vo is determined (S54) in the same manner as in the first density correction. In the subsequent printing process, a development bias Vb is calculated using the thus-determined new reference development bias Vo (S18) after the count N of printed sheets is initialized to "0."

Point c corresponds to a third density correction process which is performed because printing has been performed on a prescribed number of sheets. Therefore, printing is not suspended at point c. In this example of control, a density correction process is executed automatically every 500 sheets. Therefore, point c in FIG. 14 is a point where printing has been performed consecutively on 499 sheets. A development bias Vta for printing on the 500th sheet as counted from point b, that is, a development bias Vta corresponding to N=M=500 (in actual processing, M is set to 200 (see step S43)), is used for this density correction. Because of the continuous printing, the standing time t need not be taken into consideration (i.e., h=1) in calculating f(M, t). Therefore, M is incremented from the M value itself that was used immediately before the start of the density correction process (S42). Then, a patch is formed with the development bias Vta and a new reference development bias Vo is determined in the same manner as in the first and second density correction processes.

In actual use of the apparatus, there may occur a case that printing on a 500th sheet is to be performed in the midst of a print job. In such a case, a density correction process may be executed in an interval between jobs, more specifically, at the beginning of the next job if a density correction process is executed in the midst of a job, there may occur a difference between image densities before and after the density correction process. Executing a density correction process in an interval between jobs prevents an event that the image density varies halfway through the same job.

Point d corresponds to a fourth density correction process which is executed in response to a manipulation by a user rather than when the power is turned on or printing has been performed on a prescribed number of sheets (i.e., a regular density correction process executed every 500 sheets). Point e corresponds to a case that the apparatus has been left inactive for one hour after printing on 1,299 sheets.

If the apparatus standing time from a preceding print job is not sufficiently long, the function h takes an intermediate value between "0" and "1" and hence it is necessary to take the influence of the standing time t into consideration. Point e corresponds to a case that a density correction process is performed with such timing. Calculation of the short-term characteristic f(M, t) is started from a state that M has been increased to some extent. Therefore, in the density correction process, the development bias falls from an intermediate point of the fall curve.

Point d corresponds to a case that the apparatus has been left inactive for 1.5 hours after printing was performed consecutively on 150 sheets starting from point c. As described above, the development bias for printing is given by the following equation:

$$Vb=Vo-\alpha N-f(M, t).$$

When the print job is restarted from point d, the number M is incremented from an N value calculated according to M=M*h(t)+1 (S12) and f(M, t) (=ΔV) is calculated accordingly (S15 or S16). More specifically, since printing has been performed consecutively on more than 200 sheets starting from point b, M is temporarily set to 200. Since h(t) is set to 0.1 when the apparatus has been left inactive for 1.5 hours, M is calculated as $$M=200*0.1+1=21.$$

That is, the development bias Vb is set to such a value as would be employed for a 21st sheet in a print job that is started after the apparatus has been left inactive for a sufficient time. If printing is thereafter performed consecutively on sheets, the development bias Vb will be calculated so as to have such values as would be employed for a 22nd sheet, a 23rd sheet, and so forth.

As described above, the electrophotographic color printer 1 according to the aspect can perform image formation satisfactorily because a development bias Vb is calculated on the basis of a reference development bias Vo that is calculated by printing a patch actually. Furthermore, according to the aspect, since the development bias Vb is calculated by correcting the reference development bias Vo using a standing time t, a total number N of printed sheets, and the number M of consecutively printed sheets, image formation can be performed more satisfactorily by taking into consideration influences of a suspension of printing and standing of the apparatus, a transitional characteristic variation that occurs when a print job is started again after the suspension, and a cumulative number of printed sheets which is independent of whether or not a suspension occurred.

Since the influence of leaving the apparatus inactive is incorporated by correcting the number M of consecutively printed sheets, the processing can be made even simpler; for example, it is not necessary to prepare a complex table to deal with the standing time t. Furthermore, since a patch is also printed with a corrected development bias Vta, a patch density Da can be made even closer to a target density Dt, which enables even better image formation.

In the above aspect, steps S2 and S32 correspond to a suspension time calculating unit, steps S17 and S47 correspond to a cumulatively counting unit, the processing of adding "1" at S12 and S42 corresponds to a consecutively counting unit, the processing of calculating M*h at steps S12 and S42 corresponds to a first calculating unit and a second characteristic value correcting unit, steps S14-S18 and S44-S51 correspond to a second calculating unit, and steps S3-S18 and S33-S51 correspond to a correction amount calculating unit. Steps S52-S53 and the density sensor 80 correspond to an image forming state detecting unit, step S54 corresponds to an image formation condition calculating unit, the processing of calculating 0.02N at steps S18 and S51 corresponds to a first correction amount calculating unit, steps S15-S16 and steps S45-S46 correspond to a second correction amount calculating unit, step S52 correspond to a patch forming unit, and step S53 and the density sensor 80 correspond to a density measuring unit.

The invention is not limited to the aspect at all and various modifications are possible without departing from the spirit and scope of the invention. For example, the application field of the invention is not limited to printers and the invention can also be applied to facsimile machines, copiers, multi-function machines, etc. In particular, in multi-function machines, in the case where plural kinds of processing are being performed simultaneously, interrupt processing taking long time causes various kinds of trouble. For example, a communication is disconnected during facsimile reception when a print job is started or image reading is stopped during reading of an image to be copied when a print job is started, Processing relating to an engine control such as determination of a development bias Vb is usually performed by using an interruption. Therefore, where the invention is applied to a multi-function machine or the like, the advantages of the invention such as that the processing can be simplified by the straight line approximation etc. as described above become more remarkable.

In the above aspect, a time from an end time To of a print job to a start time Tn of the next print job is employed as a standing time t. Alternatively, the time t may be defined in accordance with the image density variation characteristic of the apparatus; for example, a time from a turning-off time (after an image forming job) of a heater large enough to influence the temperature inside the apparatus to a start time of the next image forming job may be employed as a time t. In the above aspect, the total number N of printed sheets and the number M of consecutively printed sheets are used as the first characteristic value and the second characteristic value, respectively. However, it is also possible to use, as the first characteristic value and the second characteristic value, other parameters that should influence the toner deterioration and state variation such as the number of rotations of the photoreceptor drum 62 or the developing roller 52. In other words, "the number of times of image formation" can be used as the first characteristic value and the second characteristic value.

The suspension time calculating unit may take another form such as that a capacitor is charged during printing and discharged while printing is not performed and a potential of the capacitor is measured. This is economical because it is not necessary to use an expensive clock device. In the aspect, a development bias Vb is calculated as an image formation condition. However, another image formation condition may be calculated such as an amount of charge given to the photoreceptor drum 62 when it is charged uniformly by the charger 31, an amount of exposure by the exposure unit 41, or a transfer bias.

The image forming state detecting unit is not limited to the unit for forming a patch and detecting its density. For example, it may be unit for performing test printing and detecting its image forming state. In a facsimile machine, an image forming state of a title portion of a communication management report may be detected. Furthermore, various developers can be used such as a developer for what is called two-component development, which contains a toner and a carrier.

In the above aspect, a density correction process is executed when the power is turned on or every time printing has been performed on a prescribed number of sheets. However, in apparatus such as facsimile machines that are used without turning off the power and in which the number of printed sheets is relatively small, a method of executing a density correction process every prescribed time is more effective. Furthermore t the application field of the invention is not limited to tandem image forming apparatus and the invention can be applied to image forming apparatus of various forms such as 4-cycle-type image forming apparatus and transfer-belt-type tandem image forming apparatus using an intermediate transfer body.

According to the aspects, the cumulatively counting unit counts a first characteristic value indicating the number of times of image formation by the image forming unit as a cumulative value which is irrelevant to occurrence/non-occurrence of a suspension of image formation, and the correction amount calculating unit calculates a correction amount on the basis of the suspension time and the calculated first characteristic value. Therefore, in this case, also taking into consideration the cumulative number of times of image formation, which is irrelevant to occurrence/non-occurrence of a suspension, makes it possible to perform image formation more satisfactorily by calculating a more appropriate correction amount.

According to the aspects, the consecutively counting unit counts a second characteristic value indicating the number of times images have been formed consecutively by the image forming unit without a suspension, and the first calculating unit corrects the second characteristic value counted by the consecutively counting unit on the basis of the suspension time. The second calculating unit calculates a correction amount on the basis of the first characteristic value and the second characteristic value corrected by the first calculating unit. Making a correction relating to the suspension time in the fort of a correction for the second characteristic value in this manner makes it possible to simplify the processing of the correction amount calculating unit, which provides, for example, an advantage that it is not necessary to prepare a complex table to deal with the suspension time.

According to the aspects, the use of the approximate formula consisting of linear functions can simplify the processing more and increase the processing speed further.

According to the aspects, since the correction amount calculating unit calculates a correction amount using, as a reference, a correction amount for the image formation condition that corresponds to the image forming state detected by the image forming state detecting unit, a more appropriate correction amount can be calculated, Furthermore, since the image forming state detecting unit can detect an image forming state after adjusting the image formation condition in advance on the basis of the correction amount calculated by the correction amount calculating unit, the image formation condition can be adjusted to a proper value more satisfactorily.

What is claimed is:

1. An image forming apparatus according comprising:

an image forming unit that forms an image by forming an electrostatic latent image on an image carrying body, developing the electrostatic latent image by sticking a developer on the image carrying body, and transferring the developer to a recording subject medium;

a suspension time calculating unit that calculates a suspension time for which image formation by the image forming unit is suspended; and a correction amount calculating unit that calculates a correction amount for an image formation condition of the image forming unit based on the suspension time calculated by the suspension time calculating unit, wherein the correction amount calculating unit calculates a correction amount using an approximate formula whose sections are represented by linear functions.

2. An image forming apparatus comprising:

an image forming unit that forms an image by forming an electrostatic latent image on an image carrying body, developing the electrostatic latent image by sticking a developer on the image carrying body, and transferring the developer to a recording subject medium;

a suspension time calculating unit that calculates a suspension time for which image formation by the image forming unit is suspended;

a correction amount calculating unit that calculates a correction amount for an image formation condition of the image forming unit based on the suspension time calculated by the suspension time calculating unit; and a cumulatively counting unit that counts a first characteristic value indicating the number of times of image formation by the image forming unit as a cumulative value which is irrelevant to occurrence/non-occurrence of a suspension of image formation, wherein the correction amount calculating unit calculates a correction amount based on the suspension time and the first characteristic value calculated by the cumulatively counting unit.

3. The image forming apparatus according to claim 2, further comprising:

a consecutively counting unit that counts a second characteristic value indicating the number of times images is formed consecutively by the image forming unit without a suspension, wherein the correction amount calculating unit includes:

a first calculating unit that corrects the second characteristic value counted by the consecutively counting unit based on the suspension time; and a second calculating unit that calculates a correction amount based on the first characteristic value and the second characteristic value corrected by the first calculating unit.

4. The image forming apparatus according to claim 3, wherein the first calculating unit corrects the second characteristic value by multiplying the second characteristic value by a coefficient which is a function of the suspension time, and wherein the function is defined in a plurality of ranges of the suspension time to be equal to 1 when the suspension time is equal to 0 and to be equal to 0 when the suspension time is greater than a predetermined suspension time greater than 0.

5. The image forming apparatus according to claim 4, wherein the coefficient is defined as a linear function in the plurality of ranges of the suspension time.

6. The image forming apparatus according to claim 5, wherein the plurality of ranges is four ranges.

7. The image forming apparatus according to claim 2, further comprising an image forming state detecting unit that detects an image forming state of the image forming unit, wherein the correction amount calculating unit calculates a correction amount based on a correction amount for the image formation condition that corresponds to the image forming state detected by the image forming state detecting unit.

8. An image forming apparatus comprising:

an image forming unit that forms an image by forming an electrostatic latent image on an image carrying body, developing the electrostatic latent image by sticking a developer on the image carrying body, and transferring the developer to a recording subject medium;

an image forming state detecting unit that detects an image forming state of the image forming unit;

an image formation condition calculating unit that calculates an image formation condition of the image forming unit that corresponds to the image forming state detected by the image forming state detecting unit;

a cumulatively counting unit that counts a first characteristic value indicating the number of times of image formation by the image forming unit as a cumulative value, which is irrelevant to occurrence/non-Occurrence of a suspension of image formation;

a first correction amount calculating unit that calculates a first correction amount for the image formation condition based on the first characteristic value counted by the cumulatively counting unit;

a consecutively counting unit that counts a second characteristic value indicating the number of times images is formed consecutively by the image forming unit without a suspension;

a suspension time calculating unit that calculates a suspension time for which image formation by the image forming unit has been suspended;

a second characteristic value correcting unit that corrects the second characteristic value counted by the consecutively counting, unit based on the suspension time calculated by the suspension time calculating unit; and a second correction amount calculating unit that calculates a second correction amount for the image formation condition based on the second characteristic value corrected by the second characteristic value correcting unit.

9. The image forming apparatus according to claim 8, wherein the image forming state detecting unit includes; a patch forming unit that causes the image forming unit to form a patch for density measurement; and a density measuring unit that measures a density of the patch formed by the patch forming unit.

* * * * *